US006368120B1

(12) United States Patent
Scherer et al.

(10) Patent No.: US 6,368,120 B1
(45) Date of Patent: Apr. 9, 2002

(54) HIGH SPEED CONNECTOR AND CIRCUIT BOARD INTERCONNECT

(75) Inventors: Richard J. Scherer, Austin; William R. Plummer, Leander; Wing C. Chow, Austin, all of TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/565,707

(22) Filed: May 5, 2000

(51) Int. Cl.[7] ..... H01R 4/66
(52) U.S. Cl. ..... 439/101; 439/108; 439/608
(58) Field of Search ..... 439/101, 581, 439/608, 607, 630, 63, 74, 79, 610, 578, 580, 108

(56) References Cited

U.S. PATENT DOCUMENTS 4,628,410 A 12/1986 Goodman et al. ..... 361/413
4,659,155 A * 4/1987 Walkup ..... 339/14
4,690,479 A * 9/1987 Hollyday et al. ..... 439/97
4,795,352 A * 1/1989 Capp et al. ..... 439/63
5,934,939 A 8/1999 Thenaisie et al. ..... 439/607
5,944,536 A * 8/1999 Seong et al. ..... 439/79
6,024,587 A 2/2000 Garth ..... 439/101

FOREIGN PATENT DOCUMENTS

DE 90 16 083 2/1991

* cited by examiner

*Primary Examiner*—Gary Paumen
*Assistant Examiner*—Alexander Gilman
(74) *Attorney, Agent, or Firm*—Yen Tong Florczak

(57) ABSTRACT

An electrical connector assembly includes a printed circuit board having signal traces and at least one ground trace. The ground trace includes a ground contact pad positioned adjacent an edge of the printed circuit board. A surface mount pin header is connected to the signal traces of the printed circuit board. The connector for receiving the contact pins of the pin header includes a contact beam for contacting the ground trace adjacent the edge of the printed circuit board.

15 Claims, 10 Drawing Sheets

HIGH SPEED CONNECTOR AND CIRCUIT BOARD INTERCONNECT

BACKGROUND OF THE INVENTION

The present invention relates to interconnections made between a multi-layer printed circuit board and a high speed coaxial connector. More particularly, it relates to a printed circuit board—connector combination for establishing contact between a printed circuit board and a coaxial cable. The invention provides control of signal line impedance by minimizing the length of the ground path through the connector, thereby maintaining the integrity of the high speed signals traveling through the connector.

The interconnection of integrated circuits to other circuit boards, cables, or other electronic devices is well known in the art. Such interconnections typically have not been difficult to form, especially when the circuit switching speeds (also referred to as signal transition times) have been slow when compared to the length of time required for a signal to propagate through a conductor in the interconnect or on the printed circuit board. However, as circuit switching speeds continue to increase with modern integrated circuits and related computer technology, the design and fabrication of satisfactory interconnects has grown more difficult.

Specifically, there is a growing need to design and fabricate printed circuit boards and their accompanying interconnects with closely controlled electrical characteristics to achieve satisfactory control over the integrity of the signal. The extent to which the electrical characteristics (such as impedance) must be controlled depends heavily upon the switching speed of the circuit. That is, the faster the circuit switching speed, the greater the importance of providing an accurately controlled impedance within the interconnect.

Connectors which have been developed to provide the necessary impedance control for high speed circuits are replete in the art. For example, U.S. Pat. No. 6,024,587 discloses a high speed circuit interconnection apparatus for providing electrical connection between multi-layer printed circuit boards. The art teaches that an optimum printed circuit board interconnect design minimizes the length of marginally controlled signal line characteristic impedance by minimizing the physical spacing between the printed circuit board and the connector. The art also teaches that connector designs which involve relatively large pin and socket connectors with multiple pins devoted to power and ground contacts provide only marginally acceptable performance for high speed printed circuit boards.

Unfortunately, currently available high speed interconnect solutions are typically complex, requiring extremely accurate component designs which are very sensitive to even small manufacturing variations and which, as a result, are expensive and difficult to manufacture. What is needed is a printed circuit board interconnect system which both provides the necessary impedance control for high speed integrated circuits, while still being inexpensive and easy to manufacture.

SUMMARY OF THE INVENTION

The present invention describes an interconnection system for connecting printed circuit boards and high speed coaxial connectors in an economical manner. The electrical connector assembly includes a printed circuit board having signal and ground traces, with the signal traces connected to signal contact pads and the ground traces connected to a ground contact pad. The ground contact pad is positioned adjacent an edge of the printed circuit board. A pin header is connected to the printed circuit board signal contact pads. The pin header may be a surface mount or through-hole pin header, or any other suitable pin header known in the art. A connector for receiving the pins of the pin header includes coaxial cable terminations which have a contact beam for contacting the ground contact pad adjacent the edge of the printed circuit board. In this manner, the lengths of the signal and ground paths are minimized through the interconnection, thereby providing improved connector performance in high speed systems.

DETAILED DESCRIPTION OF THE INVENTION

Figure 1:
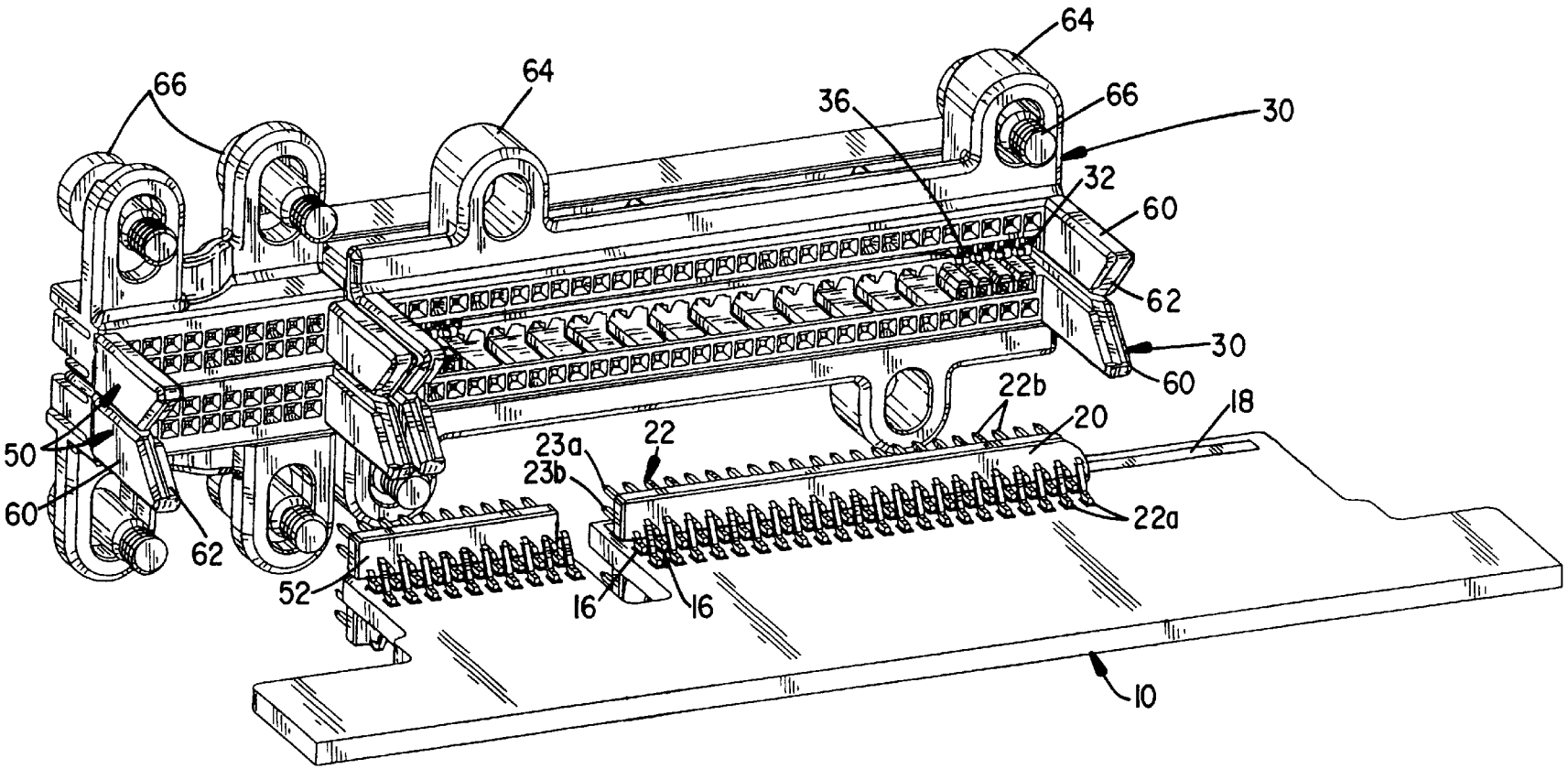
FIG. 1 is a perspective view of the inventive interconnection system.
Figure 2:
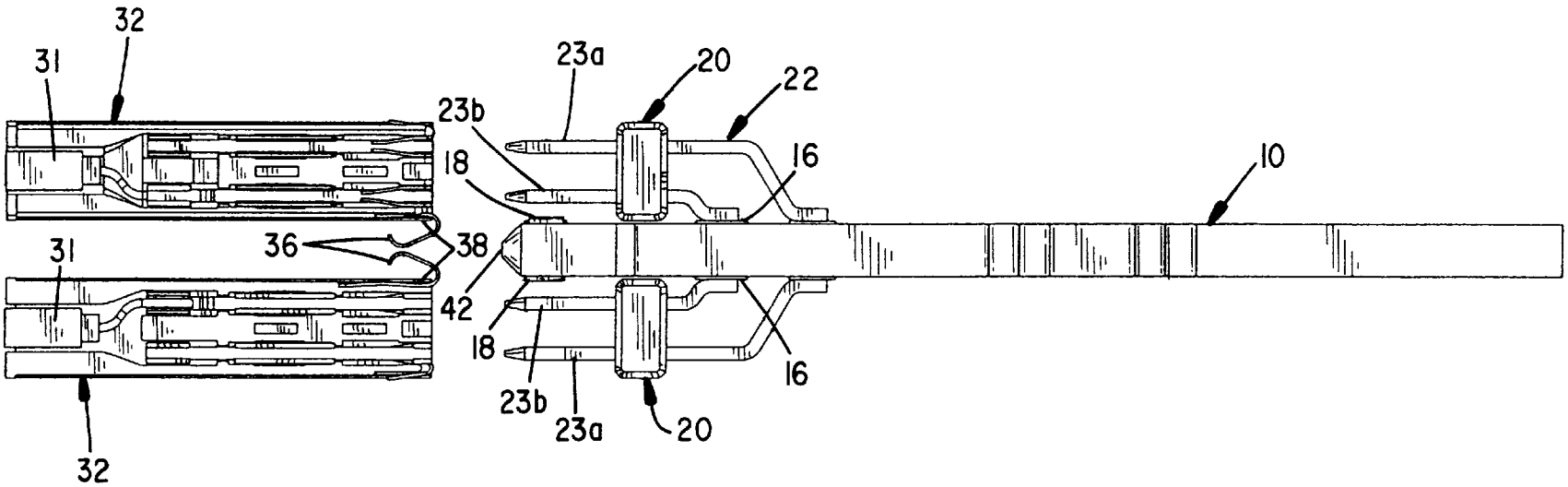
FIG. 2 is a cross-sectional view of the interconnection system.

The present invention, illustrated in FIGS. 1 and 2, includes a printed circuit board 10 having at least one signal trace (not shown) and at least one ground trace (not shown). The signal trace is connected to a signal contact pad 16, while the ground trace is connected to a ground contact pad 18. A pin header 20 includes a plurality of contact pins 22 extending from a first pin end 22*a* attached to circuit board 10 to a second pin end 22*b*. Although pin header 20 is shown and described herein as a surface mount pin header, pin header 20 may also be a through-hole pin header or any other suitable type of pin header known in the art. Pin headers are commonly available from a variety of sources, including, for example, Samtec of New Albany, IN, AMP of Harrisburg, Pa., and Minnesota Mining and Manufacturing Company of St. Paul, Minn.

The commonly available pin headers 20 include two rows 23*a*, 23*b* of contact pins 22. Typically, one row of pins is connected to a ground plane, while the second row of pins is connected to the circuit board signal traces. Most commonly, first row 23*a* (the row that is farthest from the printed circuit board 10) is connected to a ground plane, while second row 23*b* (the row that is closes to the printed circuit board 10) is connected to the signal traces of the printed circuit board 10. Of course, various combinations of pins 22 in rows 23*a* and 23*b* may be electrically connected to circuit board 10 in any number of ways.

In one embodiment of the present invention, the first row 23*a* of pins 22 is secured to the printed circuit board 10 only to lend additional mechanical stability to the pin header 20. That is, the pins 22 in row 23*a* are not electrically connected to any elements on printed circuit board 10 and could be eliminated. Alternately, pins 22 of row 23*a* may remain in electrical contact with the ground plane of circuit board 10. It should be noted that first row 23*a* is the row with the longest unshielded path through the interconnection, and for that reason the pins 22 of first row 23*b* are preferably used for electrical connection to the signal traces on printed circuit board 10. It will also be recognized that a pin header having only a single row of pins (for connection to signal contact pads 16) could be used, with the pin header being stabilized on circuit board 10 by means other than a second row of pins 22 as is illustrated in the Figures.

The contact pins 22 in second row 23*b* electrically connect to the printed circuit board 10 via signal contact pads 16. The first end 22*a* of each contact pin 22 in row 23*b* is connected to one of signal contact pads 16. As illustrated in FIGS. 1 and 2, circuit board 10 may include a pin header 20 on both sides of the circuit board 10, with similarly positioned signal pads 16 and ground contact pads 18.

Figure 3:
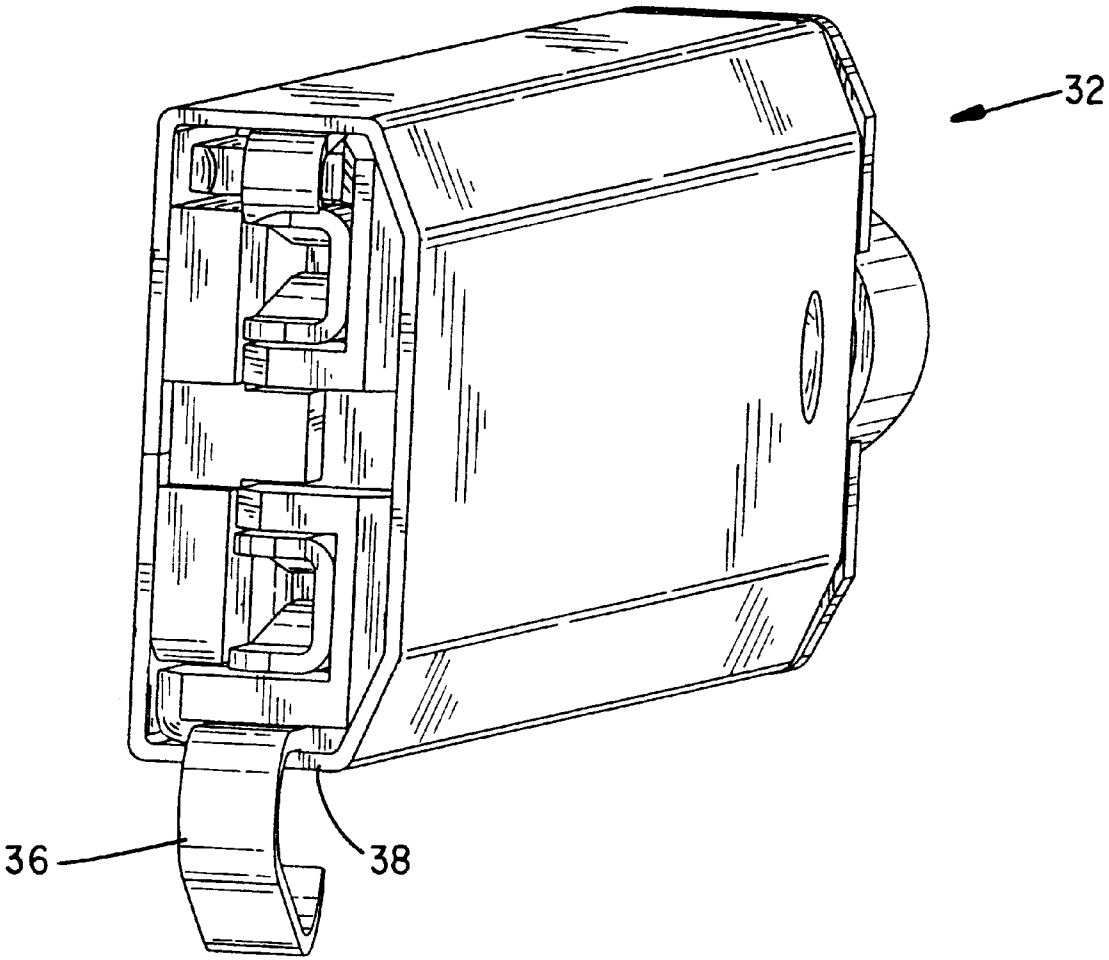
FIG. 3 is a greatly enlarged perspective view of the coaxial cable termination used in the interconnection system.

As seen in the figures, the inventive assembly also includes a connector carrier 30 for receiving the second ends 22*b* of the contact pins 22 and connecting them to coaxial cable 31. The connector carrier 30 includes a plurality of coaxial cable terminations 32 positioned within the connector housing 34. An enlarged view of a single coaxial cable termination 32 is shown in FIG. 3. Each of the plurality of coaxial cable terminations 32 is adapted to receive second ends 22*b* of a mating signal contact pins 22.

The coaxial cable terminations 32 are conventional in design, except that each coaxial cable termination 32 includes a contact beam 36 adjacent its leading edge 38 for making electrical contact with the ground contact pad 18 on the printed circuit board 10 as the connector carrier 30 engages the pin header 20. In this manner, the electrical path from the printed circuit board 10 to the coaxial cable 31 is made as short as possible, thereby dramatically improving the performance of the connector carrier 30 over what would be otherwise expected with a surface mount pin header 20.

A connector carrier 30 is provided for each pin header 20 on printed circuit board 10, with one connector positioned on either side of the printed circuit board 10. The use of connector carrier 30 on either side of printed circuit board 10 is preferred to balance the mechanical contacting force between the printed circuit board 10 and the coaxial cable terminations 32, thereby preventing the printed circuit board 10 from bending or warping over time.

Figure 4A:
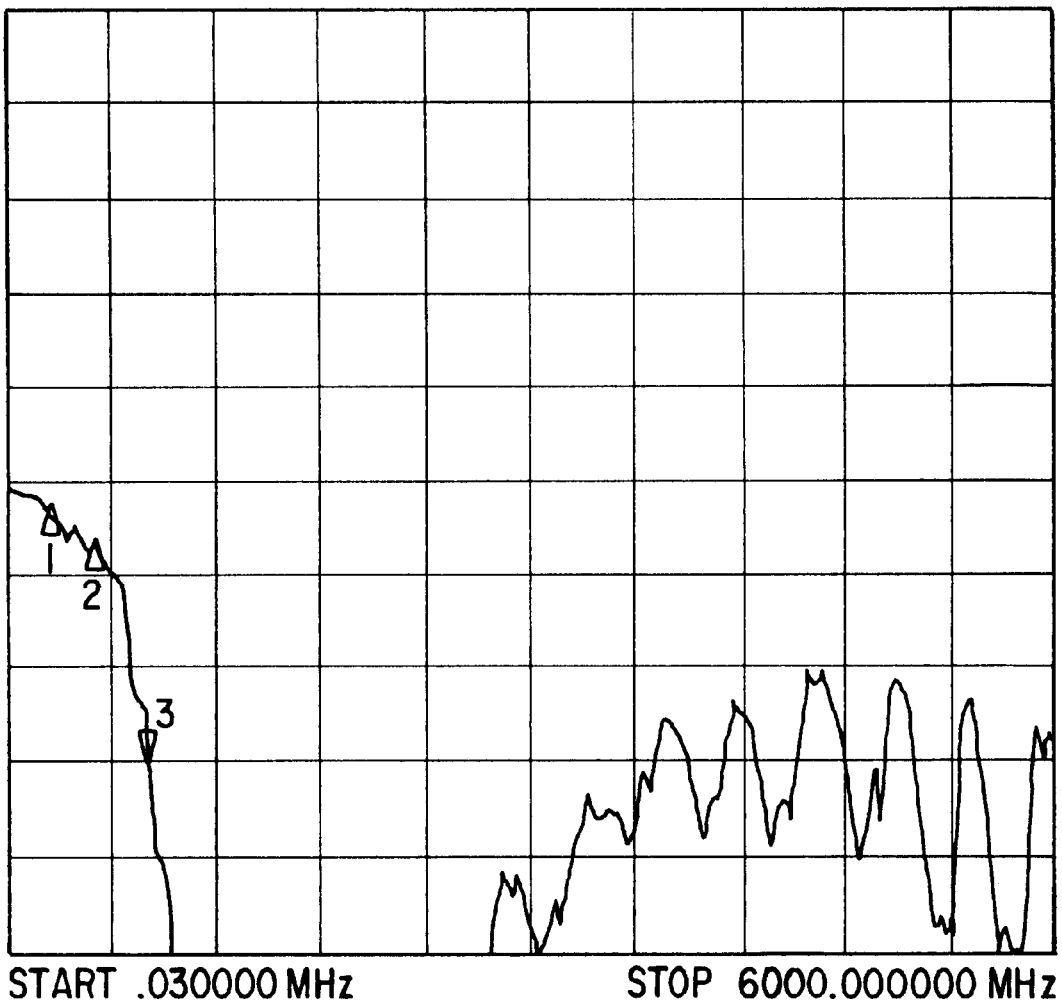
FIGS. 4*a*–4*c* are attenuation plots illustrating the improved performance of the inventive interconnection system over a range of frequencies.
Figure 4B:
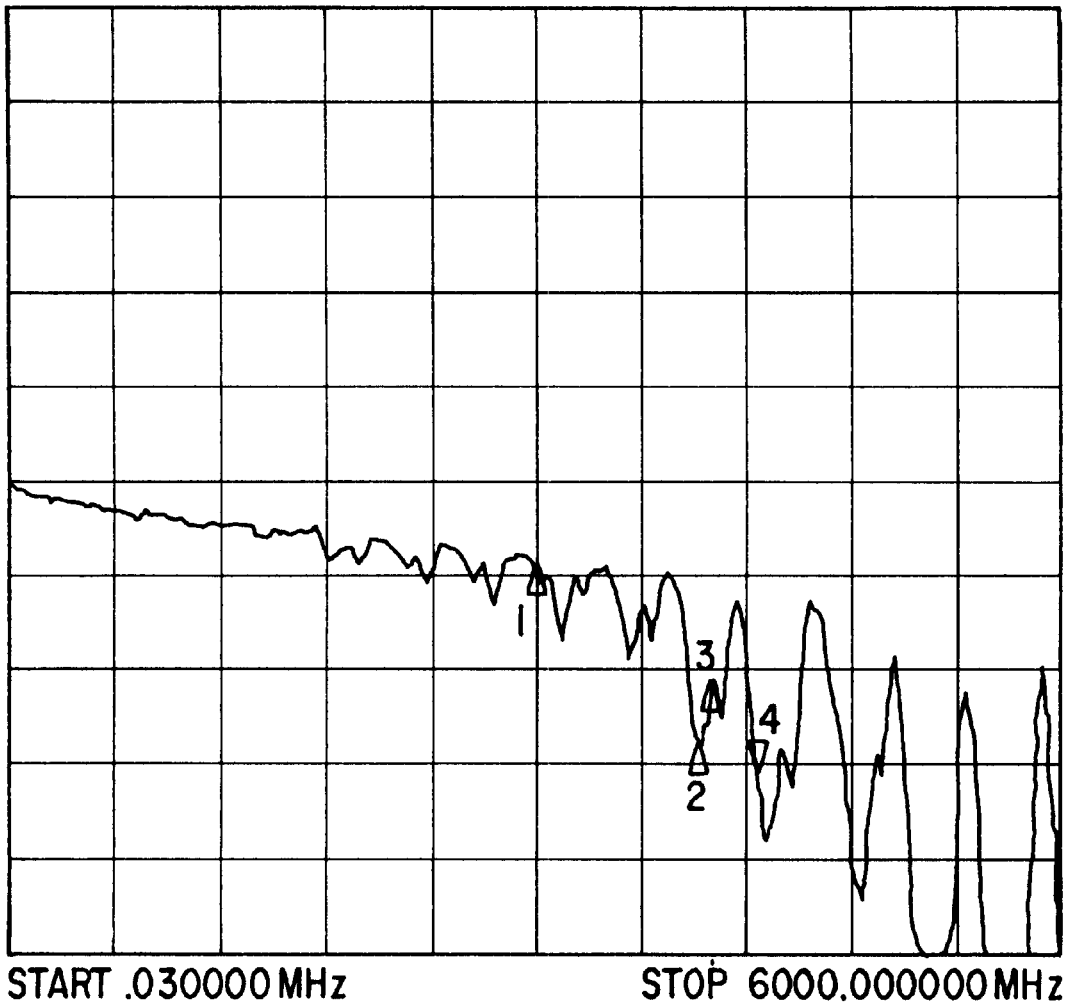
Figure 4C:
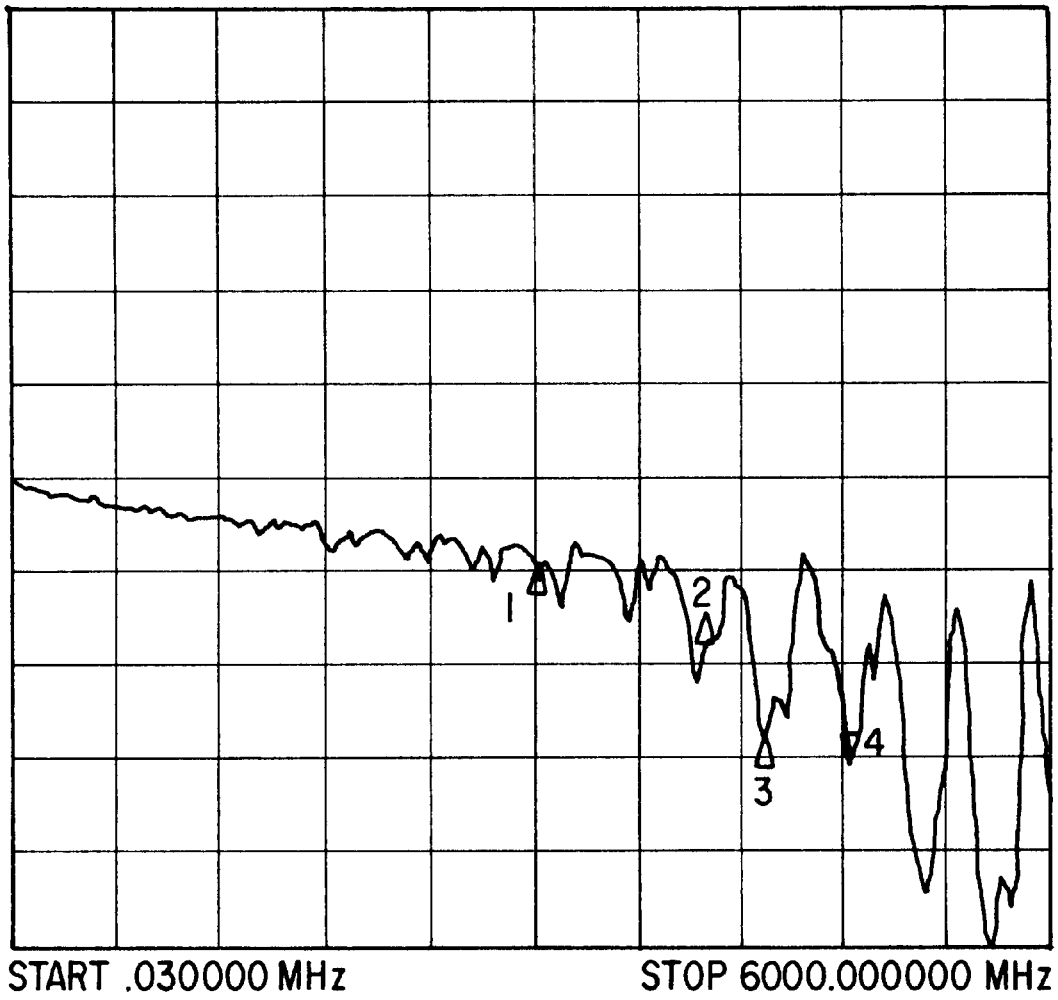

The improved performance obtained by providing ground contact pad 18 adjacent the edge 42 of printed circuit board 10 is dramatic and can be seen from the data presented in FIGS. 4*a*–4*c*. FIGS. 4*a*–4*c* plot the attenuation or loss of a sine wave signal traveling through an interconnection system over a range of frequencies. The test method for creating this data is well known in the art. The data was generated using a Tektronix CSA 803 Communications Signal Analyzer with an SD-24 TDR Sampling Head.

FIG. 4*a* illustrates the interconnect performance when the ground path is routed through a contact pin 22 of row 23*a* in the conventional manner. It is generally accepted that an attenuation of greater than −3dB (equating approximately to $V_{out}/V_{in}$ of 0.707) is not acceptable. It can be easily seen from FIG. 4*a* that the conventional type of interconnection system provides satisfactory performance only up to about 800 megahertz. This low interconnection system bandwidth is clearly not acceptable for current high performance systems. FIG. 4*b* illustrates the improved performance of the interconnect system when the ground path is routed only through contact beam 36 to contact pad 18 at edge 42 of printed circuit board 10. It can be seen that routing the ground path through contact beam 36 and ground contact pad 18 immediately adjacent edge 42 of printed circuit board 10 provides an improved system performance. The inventive interconnection system described herein provides satisfactory performance up to about 4.3 gigahertz. This is clearly a dramatic and unexpected improvement over the conventional interconnection system of FIG. 4*a*.

FIG. 4*c* illustrates the improved performance of the interconnect system when the ground path is routed both through contact beam 36 to contact pad 18 and through contact pin 22 of first row 23*a*. The combination of grounding through both contact beam 36 and contact pin 22 of row 23 provides even better performance than using contact beam 36 alone. As shown in FIG. 4*c*, this combination yields satisfactory performance up to about 4.8 gigahertz.

Figure 5A:
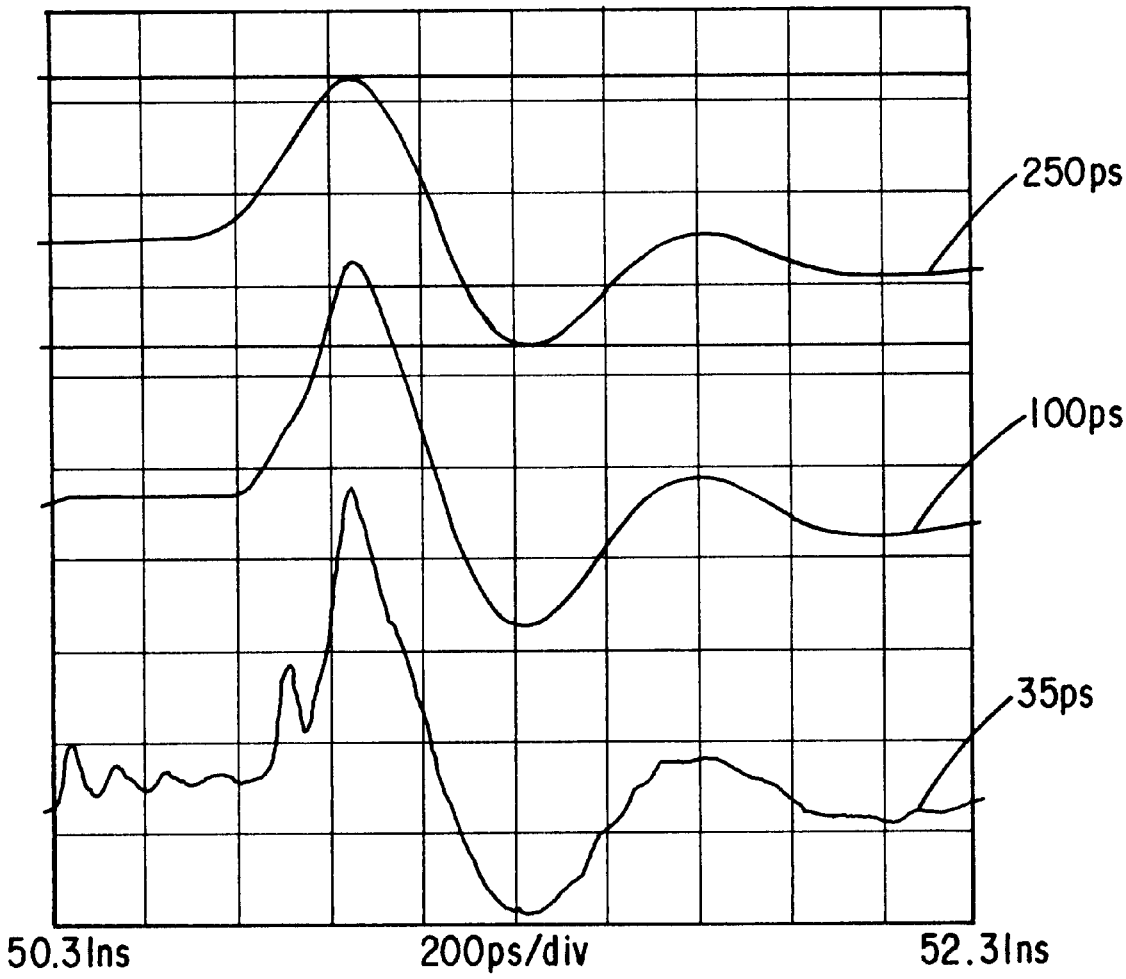
FIGS. 5*a*–5*c* are graphs illustrating the improved impedance control of the inventive interconnection system.
Figure 5B:
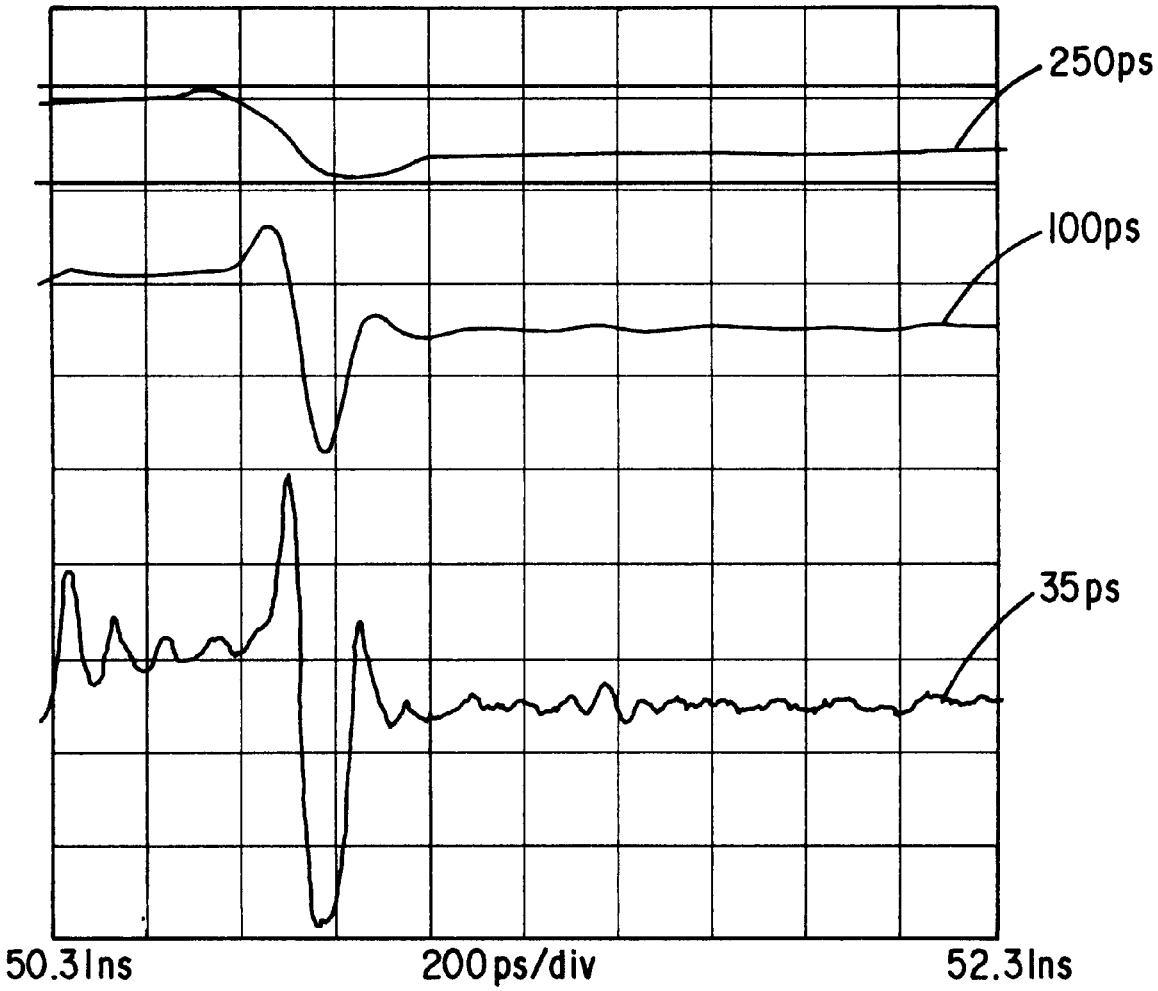
Figure 5C:
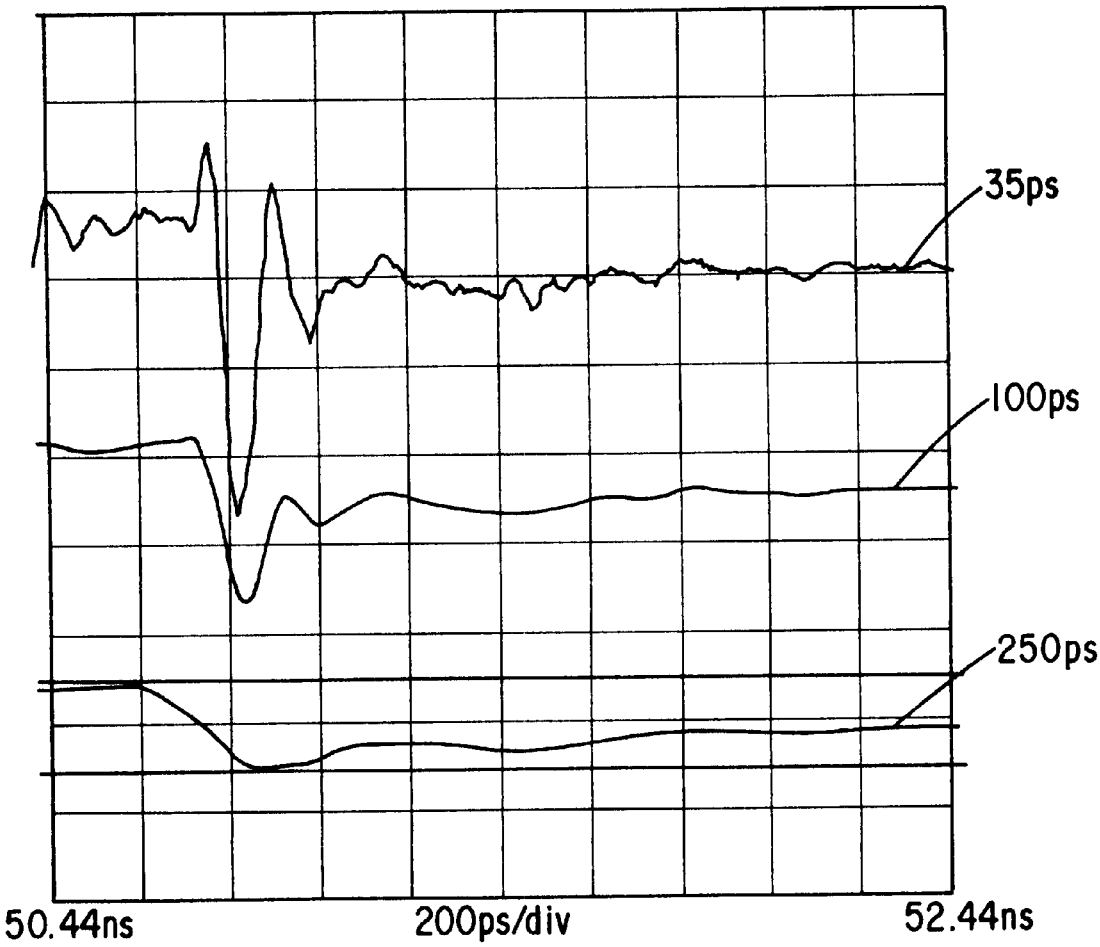

FIGS. 5*a*–5*c* show Time Domain Reflectometer (TDR) plots for the connectors of FIGS. 4*a*–4*e*. The TDR plots illustrate the changes in impedance as a signal travels through the interconnection system, with rise times of 250 picoseconds, 100 picoseconds, and 35 picoseconds. Ideally, a TDR plot of a system will have a constant impedance. When designing an interconnection system, one goal is to minimize the changes in impedance as the signal travels through the interconnection system. By minimizing the changes in impedance, distortion and attenuation of the signal are reduced, thereby improving the system performance. It can be seen by comparing the TDR plots that the inventive interconnection system using contact beam 36 and ground contact 18 (FIGS. 5*b* and 5*c*) provide much greater control over the impedance than the conventional system (FIG. 5*a*) which routes the ground path through a contact pin. Specifically, the interconnection systems utilizing the contact beam 36 show a much smoother impedance profile and a narrower impedance range through the interconnection system.

A separate power connector 50 may be mated to signal connector carrier 30 as is shown in FIG. 1. Power connector 50 connects to pin header 52 in a manner known in the art.

Figure 6:
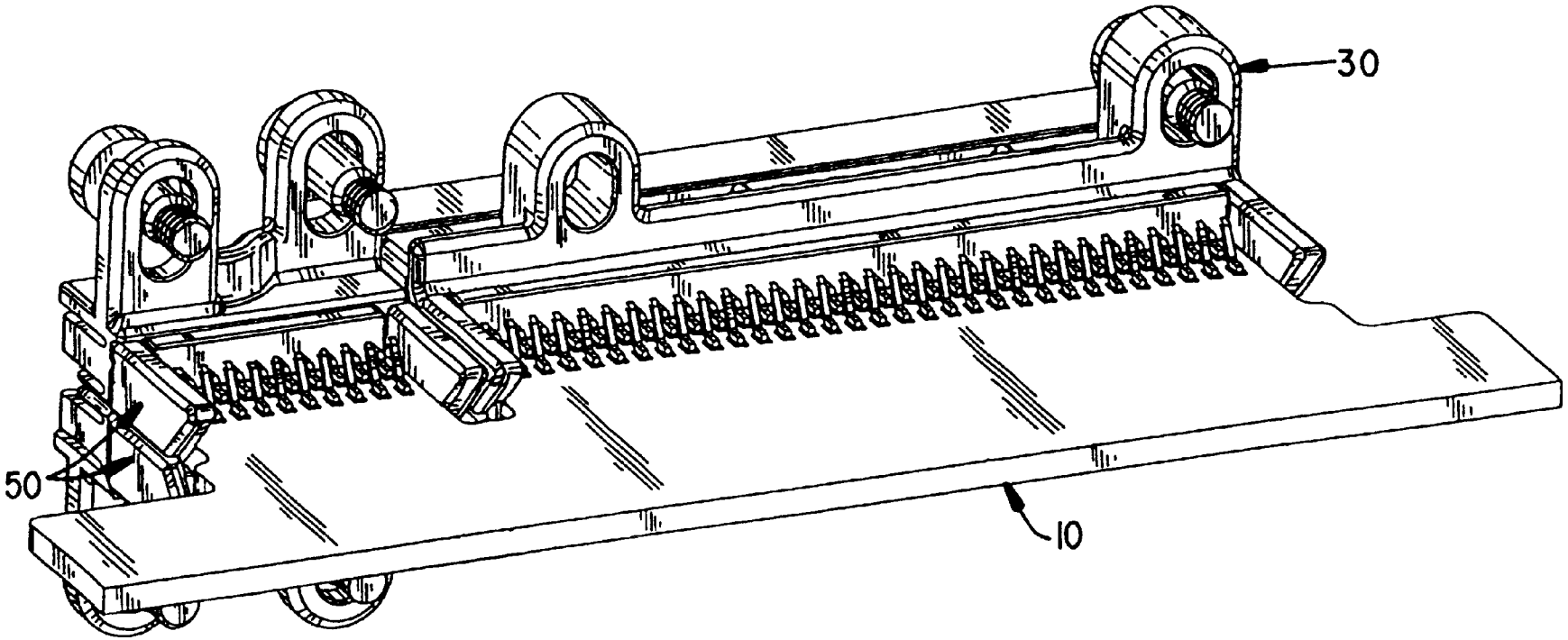
FIG. 6 is a perspective view of the interconnection system in an engaged configuration.

The connectors 30, 50 placed on opposite sides of printed circuit board 10 include guides 60 with lead-in features 62 to properly position connectors 30, 50 on printed circuit board 10. Connectors 30, 50 are shown mated to pin headers 20 on circuit board 10 in FIG. 6. Connectors 30, 50 are preferably resiliently secured against each other, such as by an elastic band or other means (not shown) which urges the connectors toward each other and against printed circuit board 10. In this manner, the connectors 30, 50 are allowed to independently "float" on circuit board 10. The ability to float on circuit board 10 permits accommodation of variations in circuit board thickness which are normal in the industry. Connectors 30, 50 also include mounting tabs or ears 64 for receiving screws 66 for securing connectors 30, 50 to the electronic device (not shown) holding printed circuit board 10.

Thus, an economical printed circuit board to high speed coaxial cable interconnection system has been demonstrated. The interconnection system uses commonly available low cost components and provides excellent performance in high speed systems. Although the invention has been described herein with reference to its preferred embodiment, those skilled in the art will recognize that modifications may be made to the invention without departing from the scope and spirit of the invention.

What is claimed is:

1. An electrical connector assembly for transmitting high speed electrical signals, the assembly comprising:

a printed circuit board having at least one signal trace and at least one ground trace, the signal trace connected to a signal contact pad and the ground trace connected to a ground contact pad;

a first pin mounted on the printed circuit board and header having at least one contact pin, a first end of the contact pin directly connected to the signal contact pad;

a first mating connector for receiving a second end of the at least one contact pin, the connector having a contact beam for directly contacting the ground trace.

2. The electrical connector assembly of claim 1, wherein the ground contact pad is positioned adjacent an edge of the printed circuit board.

3. The electrical connector assembly of claim 1, wherein the first connector includes terminations for coaxial cables, the terminations adapted to receive the second end of the contact pin and support the contact beam.

4. The electrical connector assembly of claim 1, wherein the assembly has a signal loss of less than −3 dB at frequencies greater than 1 gigahertz.

5. The electrical connector assembly of claim 1, wherein the assembly has a signal loss of less than −3 dB at frequencies within the range from 1 to 5 gigahertz.

6. The electrical connector assembly of claim 1, wherein the assembly has a variation in impedance of less than 10 ohms with a signal having a rise time of 250 picoseconds.

7. The electrical connector assembly of claim 1, wherein the printed circuit board includes at least one signal contact pad and at least one ground contact pad on each side of the printed circuit board, and further comprising a second pin header and a second connector on each side of the printed circuit board.

8. The electrical connector assembly of claim 7, wherein the first and second connectors independently float on the printed circuit board.

9. The electrical connector assembly of claim 7, wherein the first and second connectors are resiliently secured to each other.

10. The electrical connector assembly of claim 1, wherein the pin header is a surface mount pin header.

11. The electrical connector assembly of claim 1, wherein the pin header is a through-hole pin header.

12. An electrical connector assembly for transmitting high speed electrical signals between a printed circuit board and a coaxial cable, the assembly comprising:

a printed circuit board having a plurality of signal traces and at least one ground trace;

a pin header having a plurality of signal pins, a first end of each of the plurality of signal pins electrically connected to the corresponding one of the plurality of signal traces;

a connector having a plurality of coaxial cable terminations adapted to mate with the pin header and receive a second end of each of the plurality of signal pins, each of the plurality of coaxial cable terminations having a contact beam extending therefrom for making direct electrical connection to the at least one ground trace, wherein the at least one ground trace and the contact beams of the plurality of coaxial terminations are positioned to minimize the length of the signal return path formed between the ground trace on the printed circuit board and the coaxial cable termination.

13. The assembly of claim 12, wherein the at least one ground trace is positioned adjacent an edge of the circuit board.

14. The electrical connector assembly of claim 12, wherein the assembly has a signal loss of less than −3 dB at frequencies greater than 1 gigahertz.

15. The electrical connector assembly of claim 12, wherein the assembly has a signal loss of less than −3 dB at frequencies within the range from 1 to 5 gigahertz.

* * * * *